United States Patent [19]

Petrik

[11] 4,013,563

[45] Mar. 22, 1977

[54] SWIMMING POOL STRAINER CONSTRUCTION

[76] Inventor: Albert V. Petrik, 2866 Joyce Road, Roslyn, Pa. 19001

[22] Filed: May 8, 1975

[21] Appl. No.: 575,592

[52] U.S. Cl. ..... 210/407; 15/1.7; 210/470

[51] Int. Cl.[2] ..... B01D 33/34

[58] Field of Search ..... 210/169, 407, 464, 465, 210/470, 471; 15/1.7, 246.5, 256.5, 257.1; 292/305, 256.71, 256.73

[56] References Cited

UNITED STATES PATENTS

| | | | |
|---|---|---|---|
| 2,010,593 | 8/1935 | Kasik | 292/305 |
| 2,572,524 | 10/1951 | Schmeiler | 210/470 |
| 3,188,668 | 6/1965 | Buckelew | 15/1.7 |
| 3,368,686 | 2/1968 | Petrik | 210/407 |

*Primary Examiner*—Frank W. Lutter
*Assistant Examiner*—William A. Cuchlinski, Jr.
*Attorney, Agent, or Firm*—Robert K. Youtie

[57] ABSTRACT

A swimming pool strainer with a dip net having a handle, and including a blade for extension across and in front of a distal region of the dip net, the blade being generally oblique to the direction of strainer movement in operation to effect upward flow of sediment into the net.

10 Claims, 3 Drawing Figures

SWIMMING POOL STRAINER CONSTRUCTION

BACKGROUND OF THE INVENTION

It is appreciated that there are a variety of swimming pool strainers in the prior art; however, these prior strainers have not been entirely effective in the quick and easy removal of sediment from pool bottoms. For example, there is a prior art strainer of U.S. Pat. No. 3,368,686 issued to applicant herein and intending to accomplish generally the same objects. However, the device of said patent, while highly effective, does not operate with the thoroughness and efficiency of the instant device; and further, the prior art devices are more expensive to manufacture and incapable of quick and easy connection to an existing swimming pool strainer as an attachment therefor.

SUMMARY OF THE INVENTION

It is, therefore, an important object of the present invention to provide improvements in swimming pool strainers which overcome the above-mentioned difficulties, serve to achieve a highly effective cleaning and sediment removal performance with optimum hydrodynamic efficiency, and which enhanced efficiency is accomplished quickly and easily by unskilled and unstrained users, even small children.

It is another object of the present invention to provide a swimming pool strainer having the advantageous characteristics mentioned in the preceding paragraph, which is uniquely adapted for extremely inexpensive manufacture, to be sold either together with or as an attachment for a previously purchased pool strainer, so as to be capable of sale at a reasonable cost and quickly and easily adapted for attachment to a strainer without special tools or skills.

It is still another object of the present invention to provide a swimming pool strainer construction of the type described which is uniquely simple in structure, without moving parts, for extreme durability and trouble-free use throughout a long effective life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described and of which the scope will be indicated by the appended claims.

DESCRIPTION OF THE PREFERRED EMBODIMENT

Figure 1:
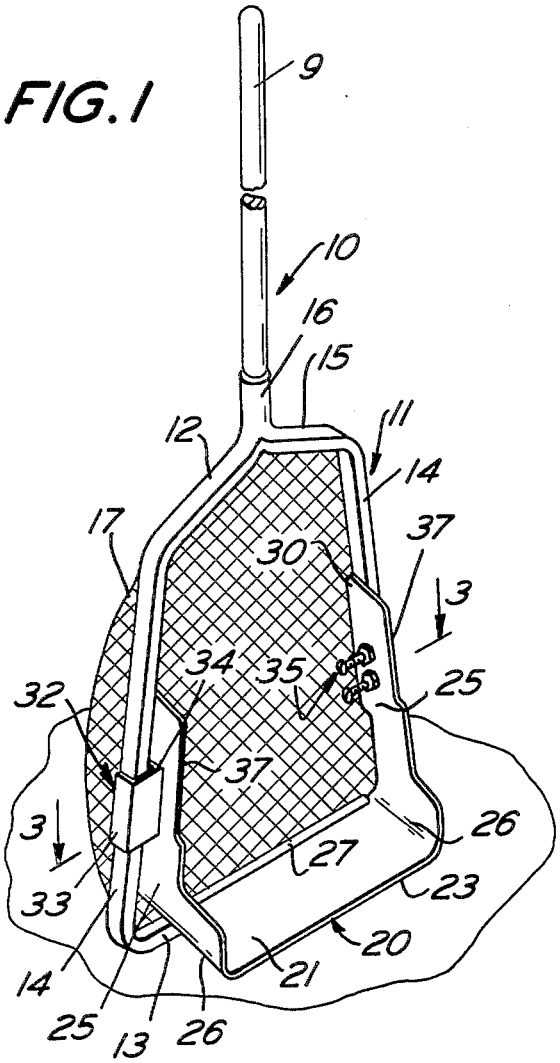
FIG. 1 is a perspective view showing a strainer of the present invention including the unique hydrodynamic sediment removal attachment.

Referring now more particularly to the drawings, and specifically to FIG. 1 thereof, a swimming pool strainer is there generally designated 10, and may be generally conventional in the inclusion of a dip net or scoop 11 and a handle 9 extending from the net. In the illustrated embodiment, and as is conventional, the dip net or scoop 11 may include a frame 12 of generally polygonal or closed outline configuration. The frame may, in particular, include a lower end or bottom side 13, a pair of side frame members 14 upstanding from opposite ends of the bottom frame member 13, and a top or inner end frame part 15 extending between the inner ends of side frame members 14. Intermediate the ends of inner frame member or part 15 there may be provided a tubular nipple or ferrule 16, outstanding away from the closed outline configuration of frame 12 and receiving an adjacent end of elongate handle 9.

While a specific configuration of strainer frame 12 is illustrated and described herein, it is appreciated that a wide variety of shapes and styles of frames may be employed in practice of the instant invention. Extending entirely across the frame 12 is suitable netting 17, or other reticulate material for receiving and retaining pool debris and sediment while passing clean water.

Figure 2:
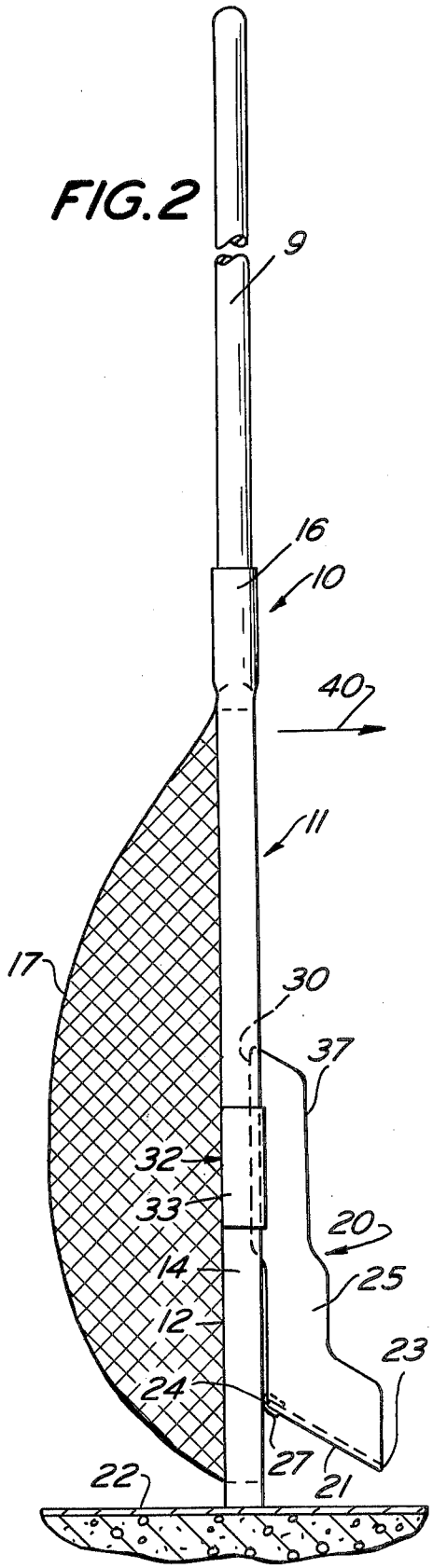
FIG. 2 is a side elevational view showing the combination of FIG. 1.
Figure 3:
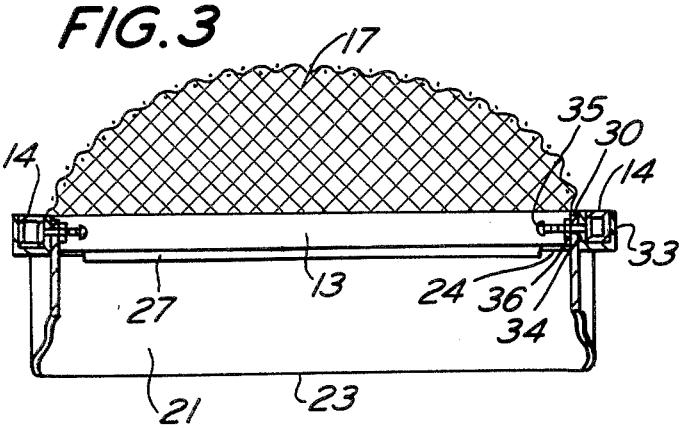
FIG. 3 is a generally horizontal sectional view taken substantially along the line 3—3 of FIG. 1.

The attachment of the present invention is generally designated 20 and may include a generally straight laterally extending blade 21 located in front of a lower region of the strainer or net 11. More specifically, the blade 21 may be generally flat, extending across and in front of a lower region of the strainer 11, spaced above the strainer bottom or outer end 13. Thus, with the outer or bottom end 13 of the strainer 11 touching the pool bottom 22, as in FIG. 2, the blade 21 is spaced over the pool bottom. Also, as best seen in FIG. 2, the generally flat blade 21 is disposed obliquely so as to incline rearwardly, as from its forward or leading edge 23 rearwardly and upwardly to its trailing edge 24. Advantageously, the leading and trailing edges 23 and 24 are generally parallel to each other and parallel to the plane of scoop frame 12.

Integral extensions 25 are provided at opposite ends of blade 21 adjacent to respective side frame members 14 and upstanding from the blade along respective side frame members. In practice, the blade 21 and both extensions 25 may be integrally fabricated of a single sheet of material, say bendable plastic material for economy, corrosion resistance and ease of assembly. In such instance, the extensions 25 each merge smoothly, as by curved mergence portions 26, with respective adjacent ends of blade 21. If desired, the material of blade 21 may be relatively thin, and reinforced against flexure as by stiffening means 27, say in the nature of a metal strip, molding or edging 27 along the rear blade edge 24. The stiffening strip 27 may terminate short of the arcuate juncture portions 26.

The extensions 25 may each include a rearward, upper portion or tab 30 extending into the plane of the frame 12, alongside of the respective adjacent frame side member 14. The rearward tab 30 is provided with attachment means, generally designated 32, for attaching each extension 25 to the adjacent frame side member 14.

More specifically, a generally U-shaped channel member or clip 33 is engaged about each frame side member 14 and has one channel side wall 34 interposed between the adjacent frame side member and extension tab 30. One or more clamping elements, such as threaded members or screws 35 extend nonthreadedly through each tab 30 and in threaded engagement into the adjacent channel side wall. Thus, by threaded shanks or bolts 35 being tightened into end engagement with frame side members 14, the clips or channels 33 are effectively clamped in position on respective frame side members. Further, additional clamping elements, such as threaded members or nuts 36 may be engaged about respective bolts or shanks 35 and threaded thereon into clamping engagement with respective extension tabs 30 to hold the latter fast against the adjacent clip or channel 33.

By this simple attachment means 32, the extensions 25 may each be quickly and easily secured in operative relation to a wide variety of shapes, sizes and styles of strainer frames 12.

It should also be observed that the forward or leading edge of each extension 25, as at 37, is cut away or recessed. This configuration permits of a multiplicity of integral blades 21 and associated extensions 25 being cut from a single sheet of material with a minimum of waste.

In operation, the pool strainer 10 is moved along the bottom 22, see FIG. 2, in the direction of arrow 40. The oblique inclination of blade 21, moving ahead of scoop 11, causes an upflow of current by reason of the blade angle inclination. This upflow of current ahead of the scoop serves to raise sediment from the pool bottom into the scoop net 17, so that the pool bottom 22 is effectively cleared of sediment and debris in advance of the strainer frame 12 to achieve a highly efficient and effective cleaning action.

From the foregoing, it is seen that the present invention provides a sediment raising attachment for a pool strainer which fully accomplishes its intended objects and is well adapted to meet practical conditions of manufacture, attachment and use.

Although the present invention has been described in some detail by way of illustration and example for purposes of clarity of understanding, it is understood that certain changes and modifications may be made within the spirit of the invention.

What is claimed is:

1. The combination with a swimming pool strainer including a handle, an open frame having a front face and extending from the handle, and net means across the frame, of a blade extending across and in front of a lower region of said frame spaced above the lower edge thereof for location adjacent to and spaced above a pool bottom upon forward strainer movement, said blade having a leading edge and a trailing edge and being generally rearwardly obliquely inclined from said leading edge to said trailing edge to effect hydrodynamic upward flow of water and sediment into said net means without scraping.

2. The combination according to claim 1, in combination with extensions on opposite ends of said blade transverse thereof, and attachment means on each of said extensions for attachment to opposite regions of said frame.

3. The combination according to claim 2, said blade being generally straight, and said extensions upstanding from said blade, for generally horizontal longitudinal disposition of said blade.

4. The combination according to claim 2, said attachment means comprising clip means for fastening engagement about opposite regions of the frame.

5. The combination according to claim 4, in combination with clamp elements associated with said clip means for fastening engagement by clamping.

6. The combination according to claim 2, said blade and extensions being integrally fabricated of a single sheet of stiff flexible material.

7. The combination according to claim 6, said blade including a longitudinally extending stiffener along the trailing blade edge.

8. The combination with a swimming pool dip net for forward movement through pool water to collect debris, of a blade extending across and in front of a lower region of the dip net spaced above the lower edge thereof for location adjacent to and spaced above a pool bottom upon forward strainer movement of the dip net to collect debris, said blade having a leading edge and a trailing edge and being oblique to the dip net to incline rearwardly from said leading edge to said trailing edge such that said dip net movement effects obliquely upward flow of pool water and sediment into the dip net without scraping.

9. The combination according to claim 8, said blade being integrally fabricated of still flexible sheet material, and a longitudinally extending stiffener along the trailing blade edge.

10. The combination according to claim 8, in combination with extensions on opposite ends of said blade transverse thereof, attachment means on each of said extensions for attachment to opposite regions of said dip net, said attachment means comprising clip means for fastening engagement about opposed regions of the dip net, and clamp elements associated with said clip means for fastening engagement by clamping.

* * * * *